US006948962B1

(12) United States Patent
DeYoung et al.

(10) Patent No.: US 6,948,962 B1
(45) Date of Patent: Sep. 27, 2005

(54) FLEXIBLE JUMPER RECEPTACLE

(75) Inventors: Jonathan R. DeYoung, Grand Rapids, MI (US); Scott J. Leenstra, Alto, MI (US); Jason S. Elzinga, Byron Center, MI (US); Ronald B. Peel, North Muskegon, MI (US)

(73) Assignee: Innotec, Zeeland, MI (US)

( * ) Notice: Subject to any disclaimer, the term of this patent is extended or adjusted under 35 U.S.C. 154(b) by 0 days.

(21) Appl. No.: 10/709,624

(22) Filed: May 18, 2004

(51) Int. Cl.[7] ..... H01R 4/60
(52) U.S. Cl. ..... 439/215; 439/211
(58) Field of Search ..... 439/215, 211, 120, 439/121, 122, 171, 174, 209, 216, 218, 214

(56) References Cited

U.S. PATENT DOCUMENTS 3,993,385 A * 11/1976 Seger ..... 439/122
4,181,388 A * 1/1980 Donato ..... 439/122
4,279,456 A * 7/1981 Zucchini ..... 439/262
4,367,370 A * 1/1983 Wilson et al. ..... 174/48
4,666,223 A * 5/1987 Tillmann ..... 439/221
4,781,609 A * 11/1988 Wilson et al. ..... 439/215
4,911,651 A * 3/1990 Jego et al. ..... 439/207
4,952,164 A * 8/1990 Weber et al. ..... 439/215
4,968,262 A * 11/1990 Widell et al. ..... 439/121
5,038,005 A * 8/1991 Hohorst et al. ..... 200/51.06
5,087,207 A * 2/1992 Byrne ..... 439/215
5,096,431 A * 3/1992 Byrne ..... 439/171
5,236,370 A * 8/1993 King et al. ..... 439/215
5,252,086 A * 10/1993 Russell et al. ..... 439/215
5,503,565 A * 4/1996 McCoy ..... 439/171
5,595,495 A * 1/1997 Johnson et al. ..... 439/215
6,036,516 A * 3/2000 Byrne ..... 439/215
6,042,399 A * 3/2000 Jaakkola ..... 439/122
6,540,536 B1 * 4/2003 Young ..... 439/215
6,652,303 B2 * 11/2003 Stockel et al. ..... 439/215

* cited by examiner

*Primary Examiner*—Ross Gushi
(74) *Attorney, Agent, or Firm*—McGarry Bair PC

(57) ABSTRACT

A receptacle for providing electrical power to an electrical power plug comprises a circuit selector for selecting one of several electrical circuits available to supply the receptacle. The circuit selector is electrically connected to a power terminal assembly, adapted for engagement with at least one power plug, through at least one flexible jumper. The flexible jumper enables the circuit selector to be moved to a preselected position for engagement with mating terminals corresponding to the selected circuit, through flexural movement of the jumpers.

15 Claims, 16 Drawing Sheets

FLEXIBLE JUMPER RECEPTACLE

FIELD OF THE INVENTION

The invention relates generally to power supply receptacles and particularly to power supply receptacles providing on-site selectability of one of several electrical power circuits available to the receptacle.

DESCRIPTION OF THE RELATED ART

Power supply receptacles provide an electrical interface between an electric power supply and one or more electrical devices that are powered by inserting a plug from the device into the receptacle. Particularly in modern office workspaces that utilize modular workspace systems, the power supply receptacles are typically modular to enable the receptacles to be readily installed at selected locations based upon a particular workspace's power requirements. In workspace systems that comprise modular wall assemblies, one or more power supplies is typically built into the wall assembly, which can comprise multiple electrical circuits for balancing the power consumption throughout the workspace.

Receptacles must be set to receive power from a preselected circuit during installation. Each receptacle typically can provide power to 2 or 3 electrical devices, which means that 2 or 3 plug outlets must be provided with each receptacle. Each plug outlet must be connectable to the electrical supply from the selected circuit, while avoiding shorting across circuits and ensuring full electrical connectivity from the power supply to each plug outlet.

Prior art power supply receptacles require a complex arrangement of switches, contacts, and electrical conductors. FIG. 1 illustrates one such receptacle, open to reveal the interior. The receptacle 280 is adapted for up to three electrical plugs and comprises a housing 282 enclosing a hot power assembly 284, a neutral power assembly 286, a ground assembly 288, and a circuit selector switch 290. The circuit selector switch 290 comprises a hot power terminal 292 and a neutral power terminal 294. The hot power terminal 292 is electrically connected to a hot slider bar 296 through a hot slider contact 298. The neutral power terminal 294 is electrically connected to a neutral slider bar 300 through a neutral slider contact 302. It can be seen that the hot slider contact 298 will remain connected to the hot slider bar 296 as the circuit selector switch 290 is moved laterally to one of three positions. Similarly, the neutral slider contact 302 will remain connected to the neutral slider bar 300 as the circuit selector switch 290 is moved laterally.

The hot slider bar 296 is electrically connected to the hot power assembly 284, which includes electrical plug contacts 304 for the hot blades of the electrical plugs. Similarly, the neutral slider bar 298 is electrically connected to the neutral power assembly 286, which includes electrical plug contacts 306 for the neutral blades of the electrical plugs. A ground terminal 308 is also electrically connected to the ground assembly 288, which includes electrical plug contacts 310 for the ground prongs of the electrical plugs. The ground terminal 308 remains stationary as the circuit selector switch 290 is moved.

It can be seen that the circuit selector switch, electrical contacts, slider bars, power assemblies, and terminals are assembled from a multitude of individual components, each having a different configuration, which must be properly fabricated and assembled for the receptacle to properly and safely operate. This complex configuration complicates fabrication and assembly of the receptacle. Furthermore, the slidable connection of the power terminals and slider bars suffers from deficiencies. For example, friction between the slider contact and slider bar can impede the movement of the circuit selector switch. Additionally, corrosion between the slider bar and the slider contact can reduce the electrical conductivity between the two components.

SUMMARY OF THE INVENTION

A modular power plug receptacle is used with an electric power supply comprising an array of paired power supply terminals corresponding to at least two electric power supply circuits and at least one ground terminal. The modular power plug receptacle comprises a movable circuit selector, a power terminal assembly, and at least one flexible jumper electrically interconnecting the power terminal assembly and the circuit selector, whereby the at least one flexible jumper enables the circuit selector to be moved relative to the power terminal assembly without the potential for interruption of the electrical connectivity between the circuit selector and the power terminal assembly.

The at least one flexible jumper can comprise a strap-like member or a wire, and can be made of copper, copper alloy, brass, or aluminum. The circuit selector can be movable to select one of at least two electric power supply circuits. The circuit indicator can be adapted to identify the selected one of the at least two electric power supply circuits.

DESCRIPTION OF AN EMBODIMENT OF THE INVENTION

Figure 1:
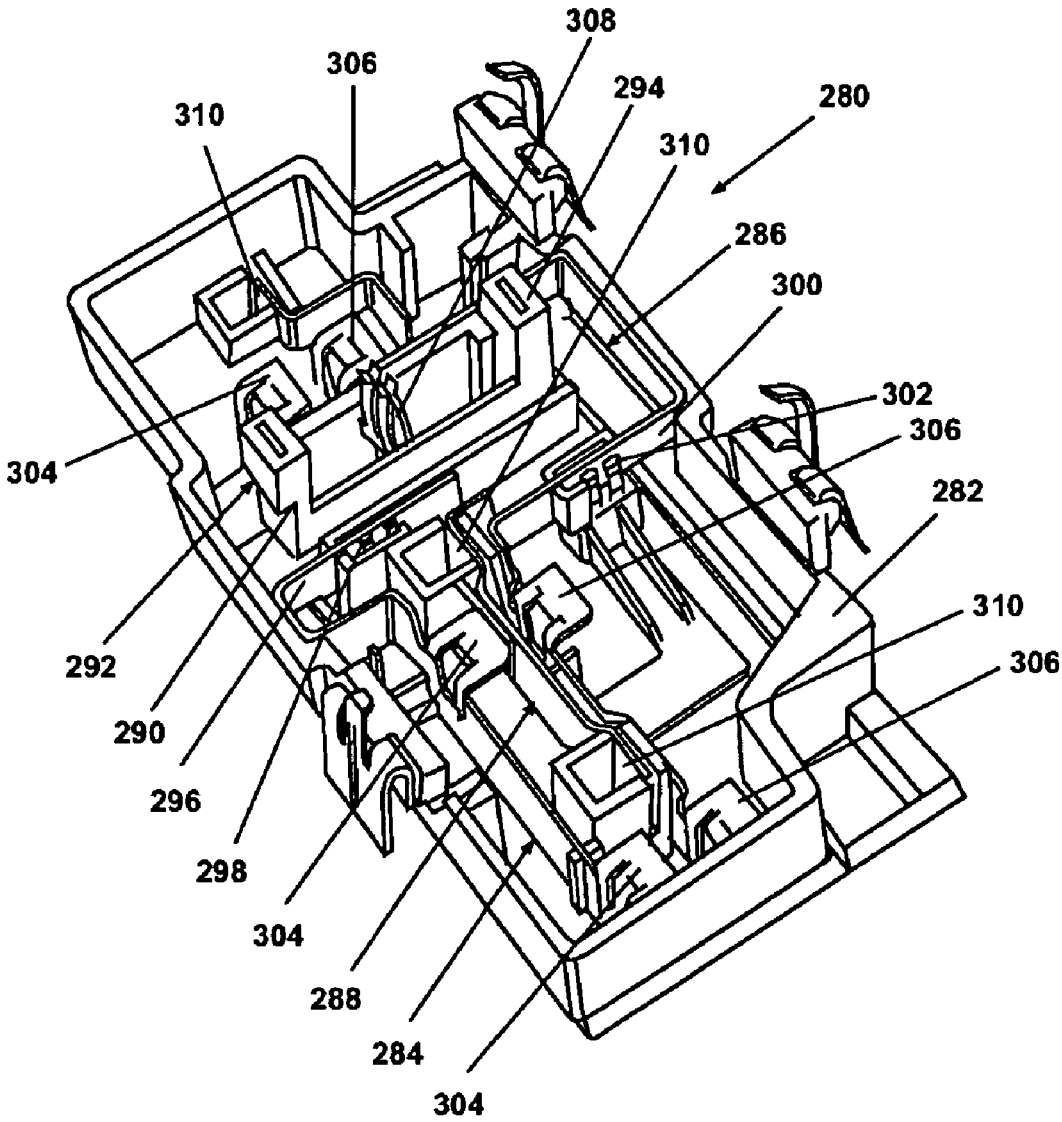
Fig. 1 (PRIOR ART)
FIG. 1 is a perspective view of a prior art power supply receptacle with portions illustrated in phantom for purposes of clarity.
Figure 2:
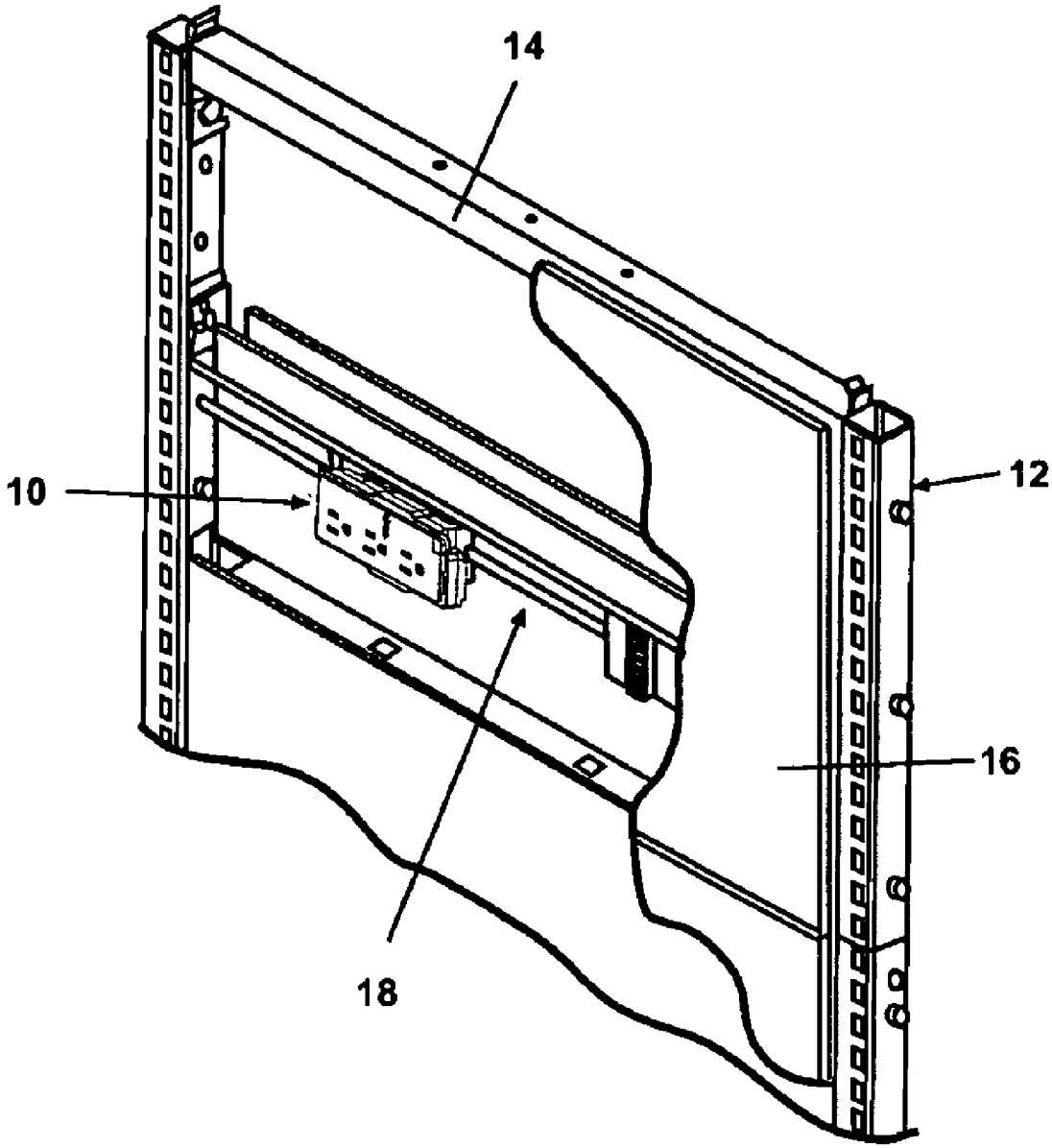
FIG. 2 is a partial cutaway view of a modular wall assembly illustrating an integrated power supply and a flexible jumper receptacle according to the invention.

Referring to the drawings, and particularly to FIG. 2, a modular power plug receptacle according to the invention, hereinafter referred to as a flexible jumper receptacle 10, is illustrated installed in a well-known modular wall assembly 12, such as might be utilized to define a workspace. The modular wall assembly 12 comprises a wall frame 14 and a plurality of panels 16, and is provided with an integrated power distribution assembly 18 for providing power to the wall assembly 12 in a well-known manner. The flexible jumper receptacle 10 is selectively integrated into the power distribution assembly 18 as hereinafter described.

Figure 3:
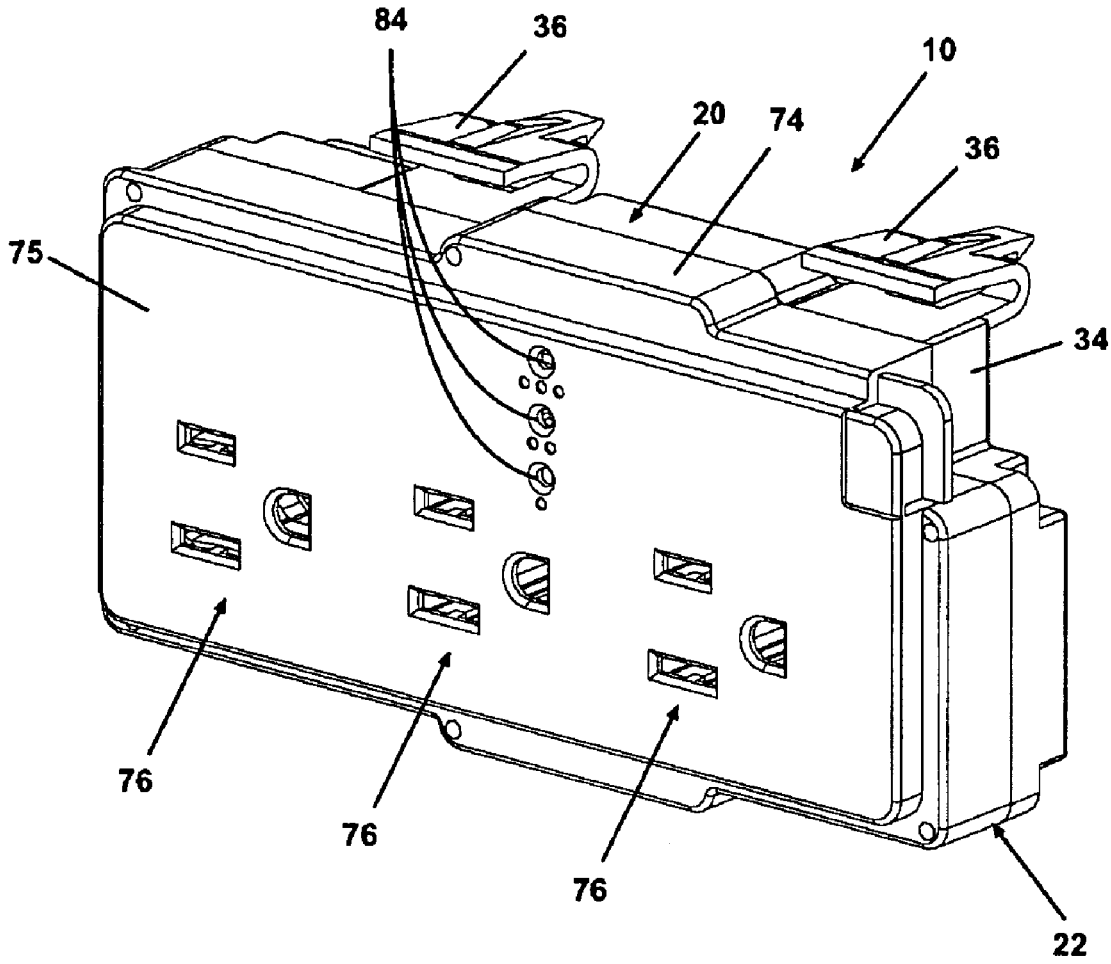
FIG. 3 is a perspective view of the assembled flexible jumper receptacle illustrated in FIG. 2.
Figure 4:
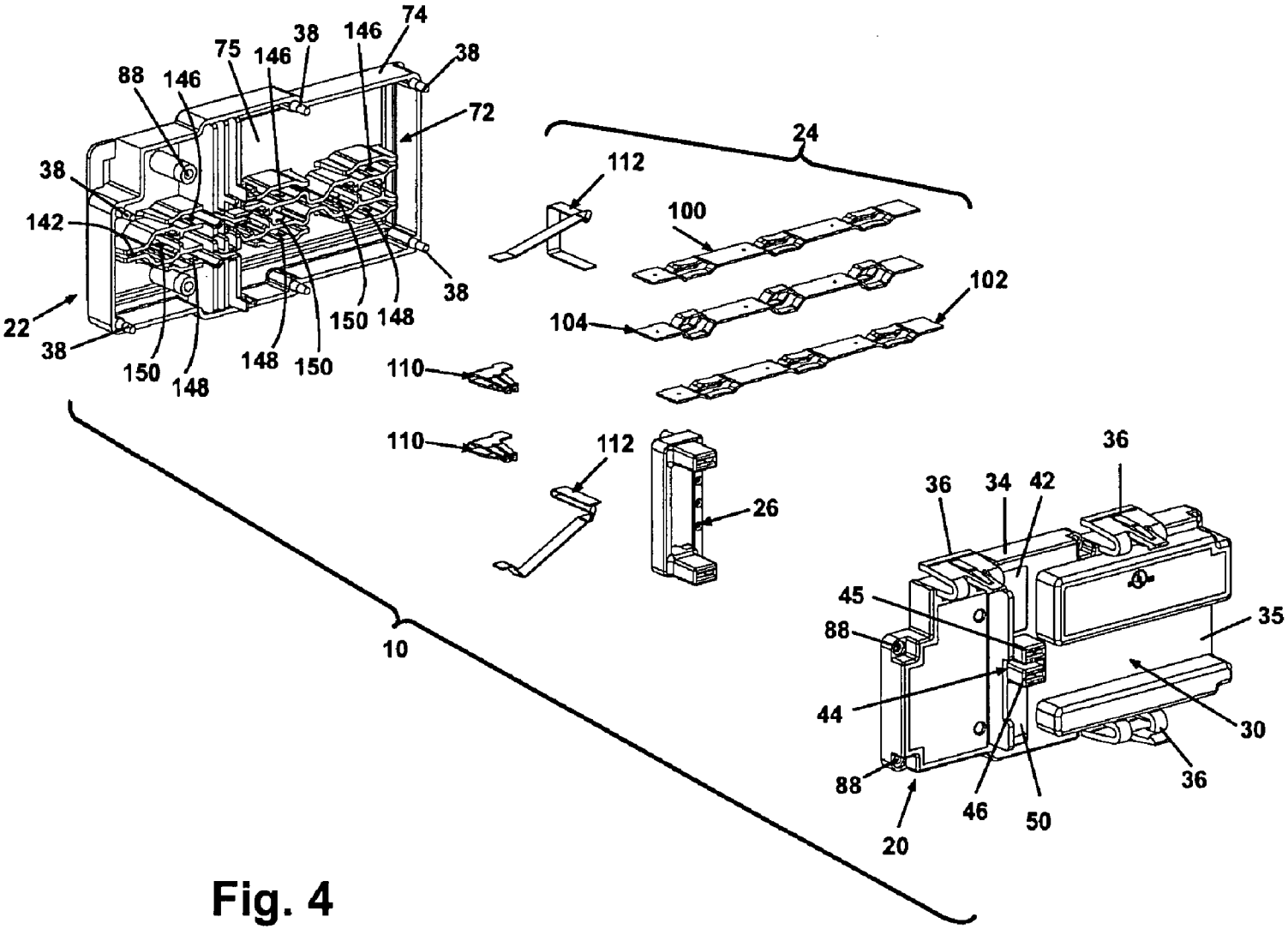
FIG. 4 is a first exploded view of the flexible jumper receptacle illustrated in FIG. 2 illustrating a mounting-side housing and a plug-side housing enclosing a power terminal assembly comprising flexible jumpers and a circuit selector.
Figure 5:
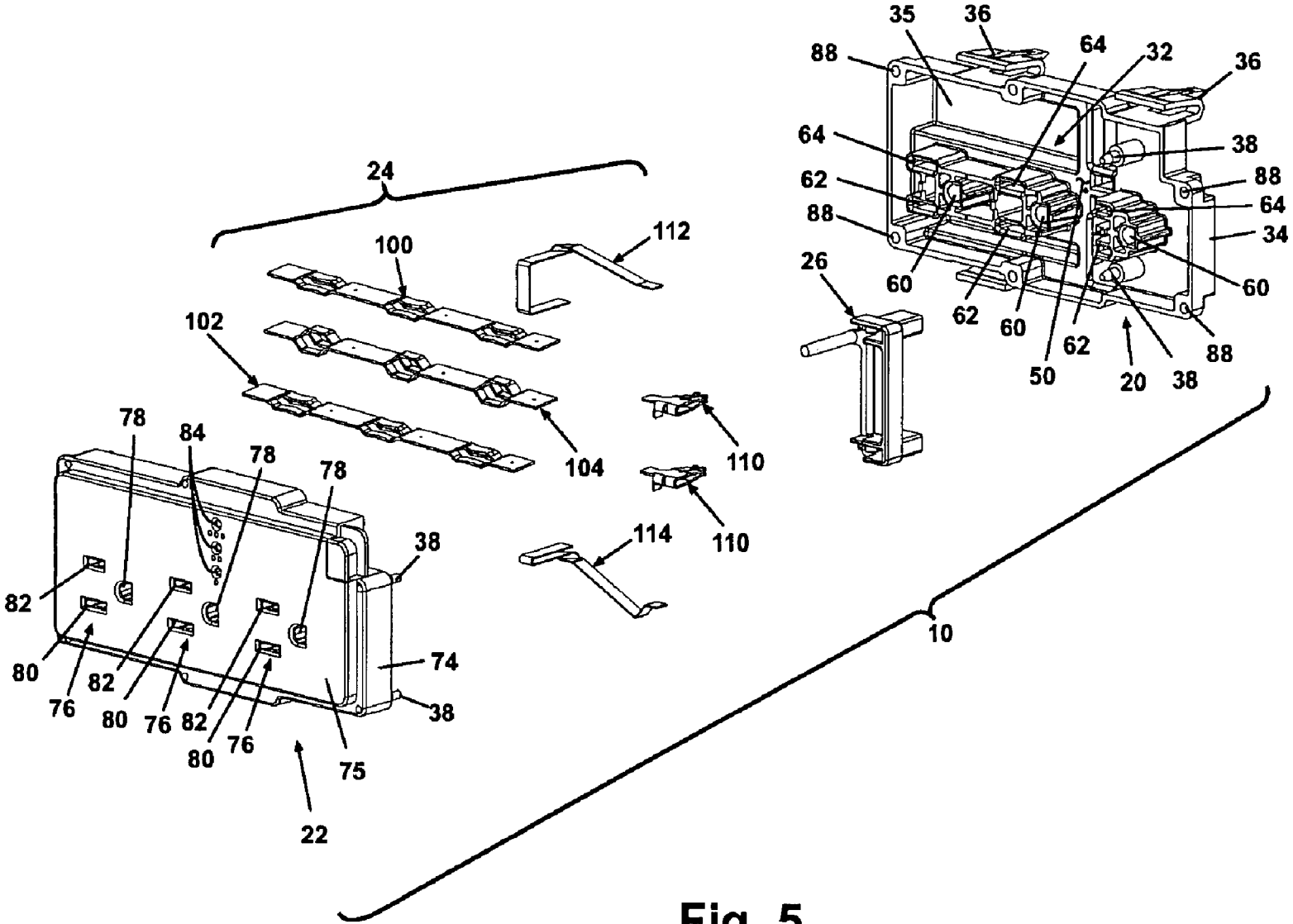
FIG. 5 is a second exploded view of the flexible jumper receptacle illustrated in FIG. 2.

Referring now to FIGS. 3–5, the flexible jumper receptacle 10 is illustrated comprising a mounting side housing 20 and a plug side housing 22 enclosing a power terminal assembly 24 and a circuit selector 26. As illustrated in FIGS. 4 and 5, the mounting side housing 20 is a generally rectilinear-shaped, box-like body having an external side 30 and an internal side 32 separated by a back wall 35. A perimeter wall 34 circumscribes the mounting side housing 20 to define with the back wall 35 a cavity 50, and is provided with a plurality of well-known latches 36 and alignment pins 38 extending generally orthogonal thereto.

Figure 6A:
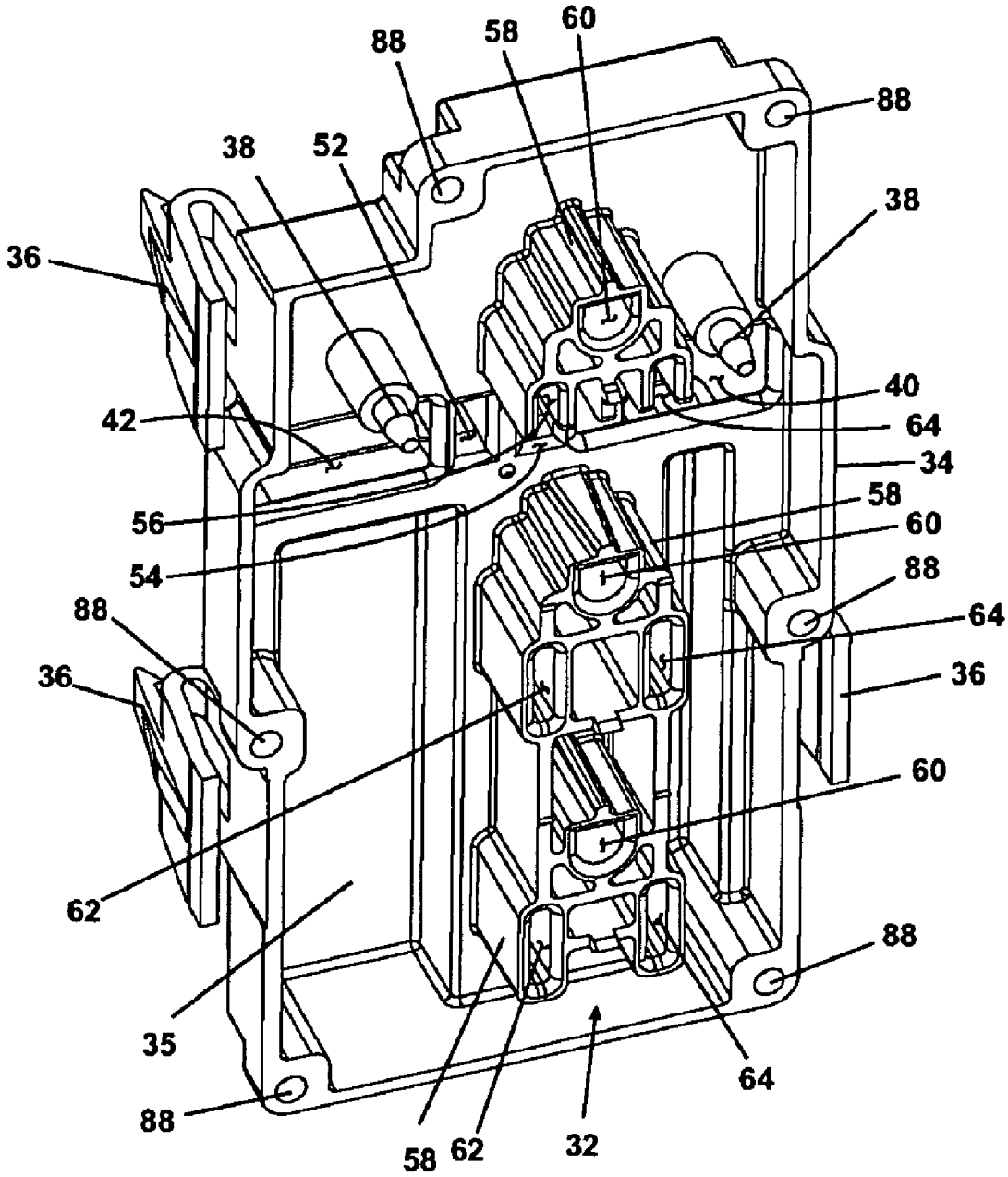
FIG. 6A is a perspective view of an internal side of the mounting-side housing illustrated in FIG. 3.
Figure 6B:
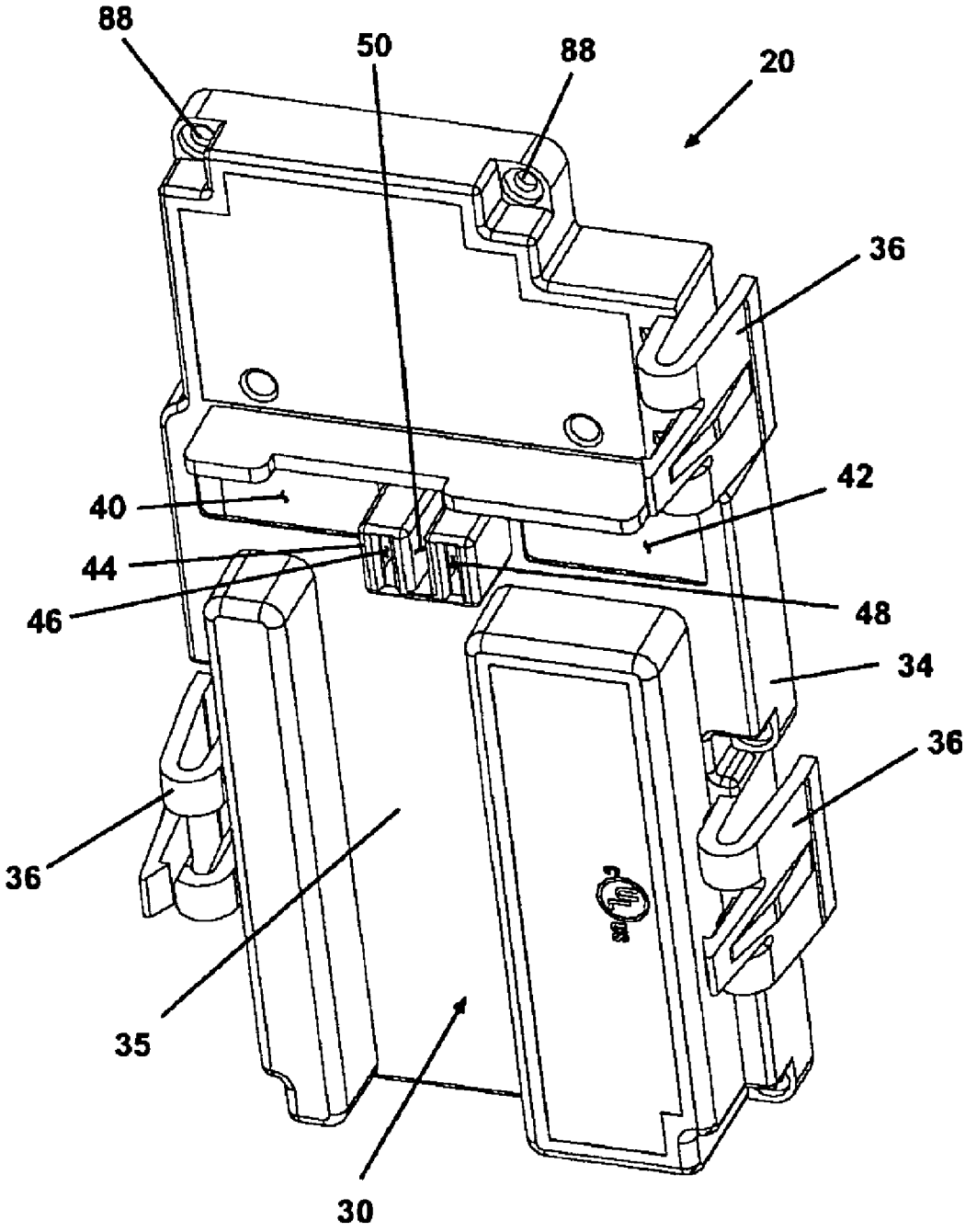
FIG. 6B is a perspective view of an external side of the mounting-side housing illustrated in FIG. 3.

Referring also to FIGS. 6A and B, a pair of slider slots 40, 42 extends through the mounting side housing 20, separated by a ground terminal pedestal 44 extending orthogonally from the external side 30. The ground terminal pedestal 44 is a generally hollow, rectilinear extension of the external side 30, terminating in a pair of ground terminal slots 46, 48 opening into a pair of terminal chambers 52, 54 in communication with the cavity 50. Referring specifically to FIG. 6A, a slider boss 56 comprising an inwardly-directed hemispherical projection extends into the cavity 50 adjacent the ground terminal slots 46, 48.

A plug pedestal 58 extends longitudinally into the cavity 50 and comprises a generally rectilinear structure having a plurality of ground pin receptacles 60, and a plurality of power blade receptacles 62, 64 adapted for insertion of a conventional electrical power plug (not shown), so that, when the power plug is inserted into the flexible jumper receptacle 10, the ground pin is slidably inserted into the ground pin receptacle 60, and the power blades are slidably inserted into the power blade receptacles 62, 64, as hereinafter described. The plug pedestal 58 is illustrated as capable of receiving up to three power plugs in linear arrangement. However, the flexible jumper receptacle 10 can be selectively adapted to accommodate more or fewer power plugs in accordance with the inventive concepts described herein. As well, the plug pedestal 58 is illustrated as interrupted by the slider slots 40, 42 and the terminal chambers 52, 54.

Figure 7A:
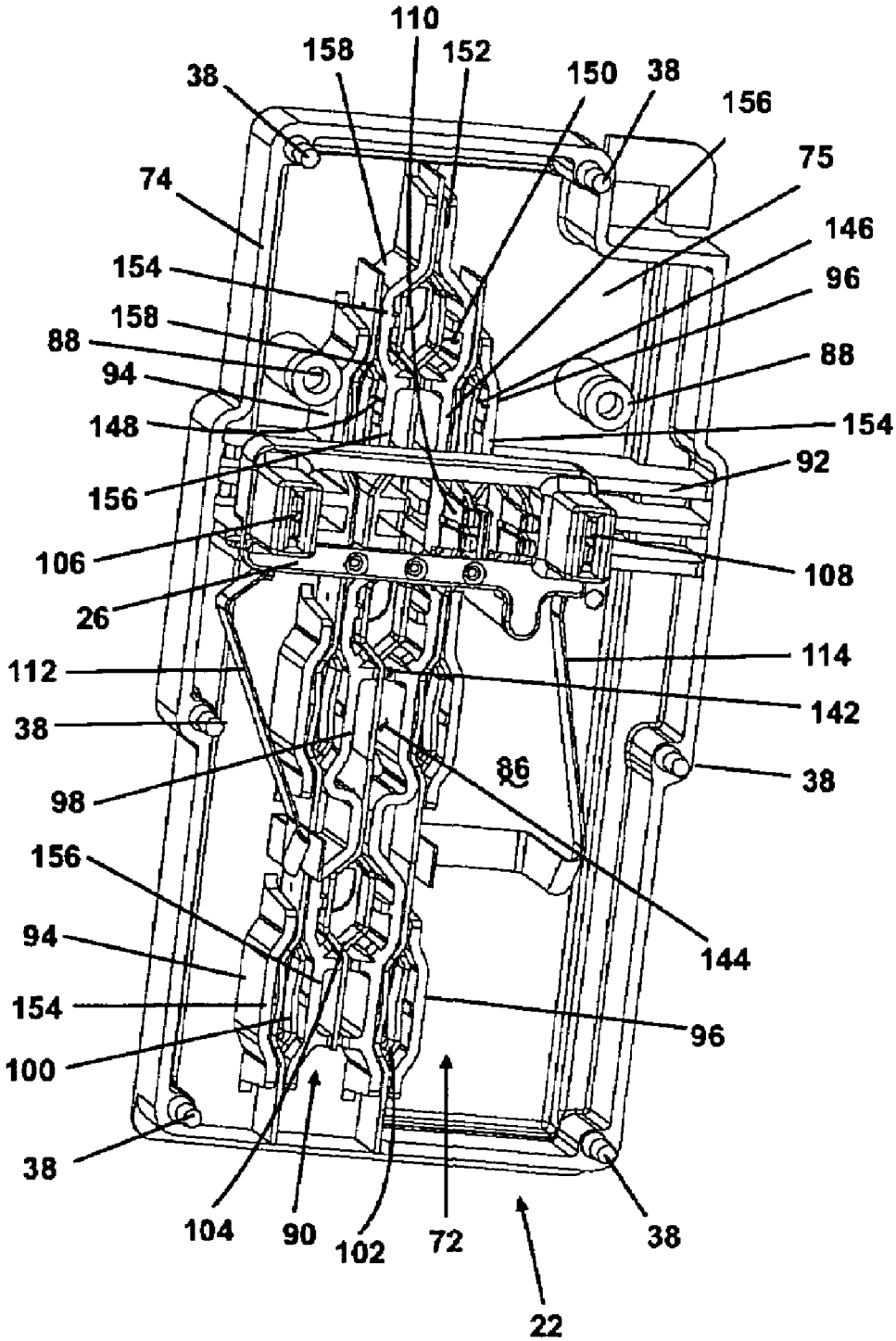
FIG. 7A is a perspective view of an internal side of the plug-side housing illustrated in FIG. 3 with the power terminal assembly, the flexible jumpers, and the circuit selector.
Figure 7B:
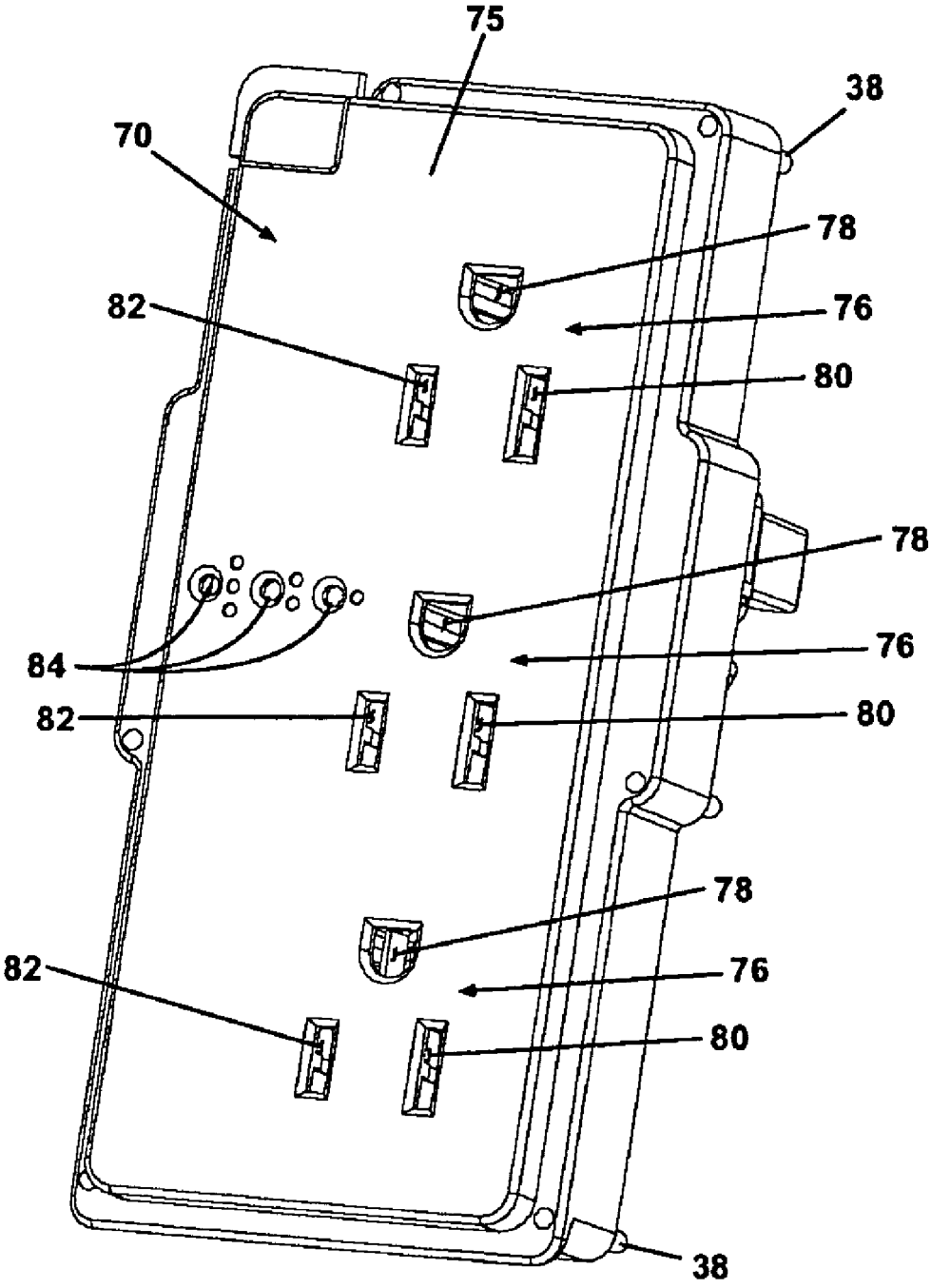
FIG. 7B is a perspective view of an external side of the plug-side housing illustrated in FIG. 3.

Referring again to FIGS. 4 and 5, and to FIGS. 7A and B, the plug side housing 22 is a generally rectilinear-shaped, box-like body having an external side 70 and an internal side 72 separated by a front wall 75. A perimeter wall 74 circumscribes the plug side housing 22 to define a cavity 86, and is provided with a plurality of pin receptacles 88 adapted for cooperative register with the alignment pins 38 so that the mounting side housing 20 can be matingly attached to the plug side housing 22 to form the flexible jumper receptacle 10.

The external side 70 is provided with a plurality of plug seats 76 comprising a ground pin opening 78, and power blade slots 80, 82 adapted for insertion of a conventional electrical power plug (not shown). In the assembled flexible jumper receptacle 10, the ground pin openings 78 are cooperatively aligned with the ground pin receptacles 60, and the power blade slots 80, 82 are cooperatively aligned with the power blade receptacles 62, 64, respectively, for insertion of the ground pin and power blades of a power plug into the openings 78–82 and the receptacles 60–64.

Figure 8:
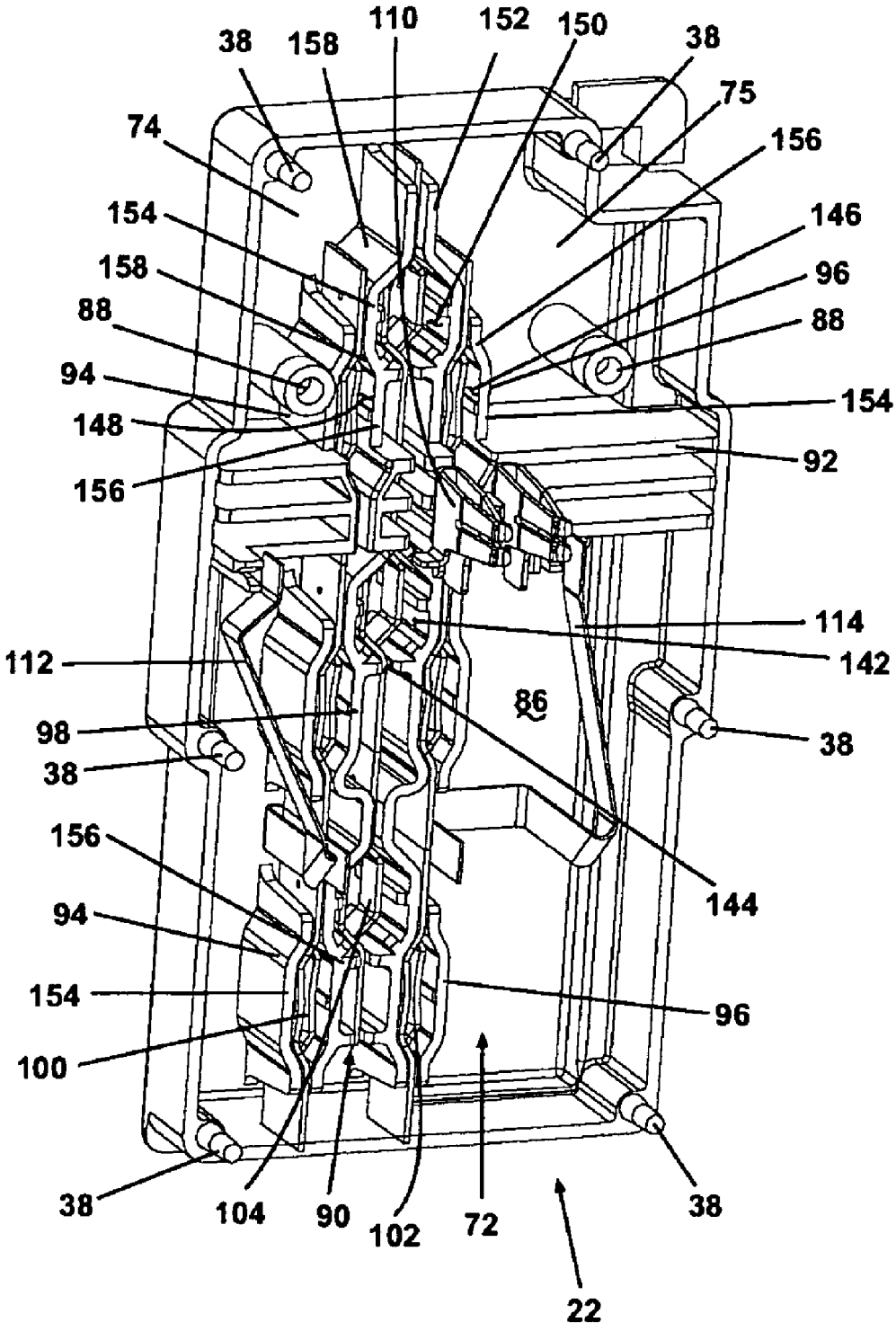
FIG. 8 is a perspective view of the internal side of the plug-side housing illustrated in FIG. 7A with the circuit selector removed for clarity.

Referring specifically to FIG. 8, the internal side 72 is provided with a plug power bank 90 and a slider bridge 92. The plug power bank 90 is an elongated, irregularly-shaped structure extending orthogonally into the cavity 86 in cooperative alignment with the plug seats 76. The plug power bank 90 comprises a pair of lateral walls 94, 96 in parallel, spaced-apart juxtaposition, separated by a medial housing 98 extending the length of the plug power bank 90. The shape and separation of the medial housing 98 and the lateral walls 94, 96 accommodate the power terminal assembly 24, which comprises a pair of power leads 100, 102 and a ground lead 104. The power leads 100, 102 extend longitudinally between the medial housing 98 and the lateral walls 94, 96. The ground lead 104 extends medially through the medial housing 98 generally parallel to the power leads 100, 102.

Figure 9:
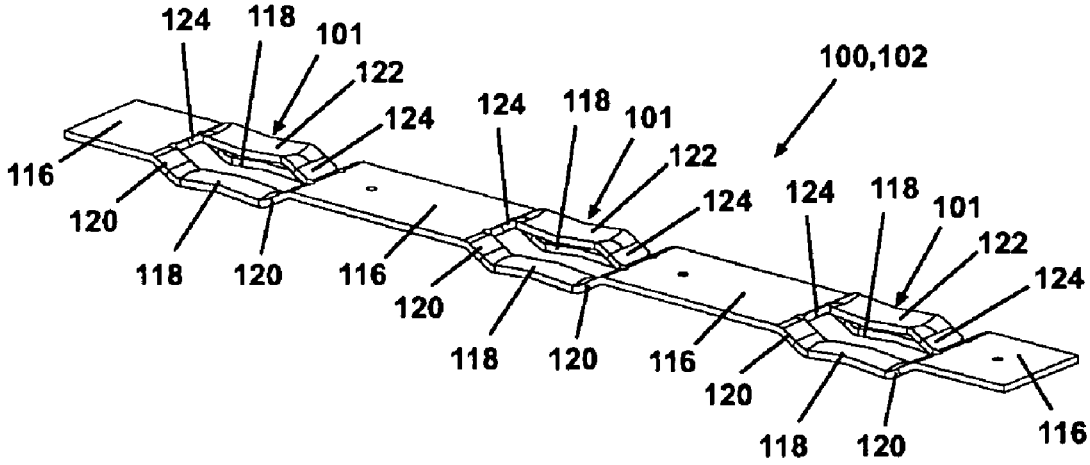
FIG. 9 is an enlarged perspective view of a power lead illustrated in FIG. 4.

Referring to FIG. 9, a power lead 100, 102 is an elongate, strap-like member fabricated of an electrically-conductive material such as copper, copper alloy, brass, or aluminum. Each power lead 100, 102 comprises a plurality of longitudinal sections 116 alternating with a plurality of plug blade receptacles 101. The plug blade receptacles 101 comprise short strap-like members separated by longitudinal slits and formed into a pair of offset sections 118 and an inset section 122 adapted for slidable engagement with the power blade of an electrical power plug. The offset sections 118 and inset section 122 transition smoothly from the longitudinal sections 116 by inclined sections 120, 124, respectively. The length of the power lead 100, 102 and position of the plug blade receptacles 101 are adapted for slidable insertion into the plug power bank 90 as shown in FIG. 8.

Figure 10:
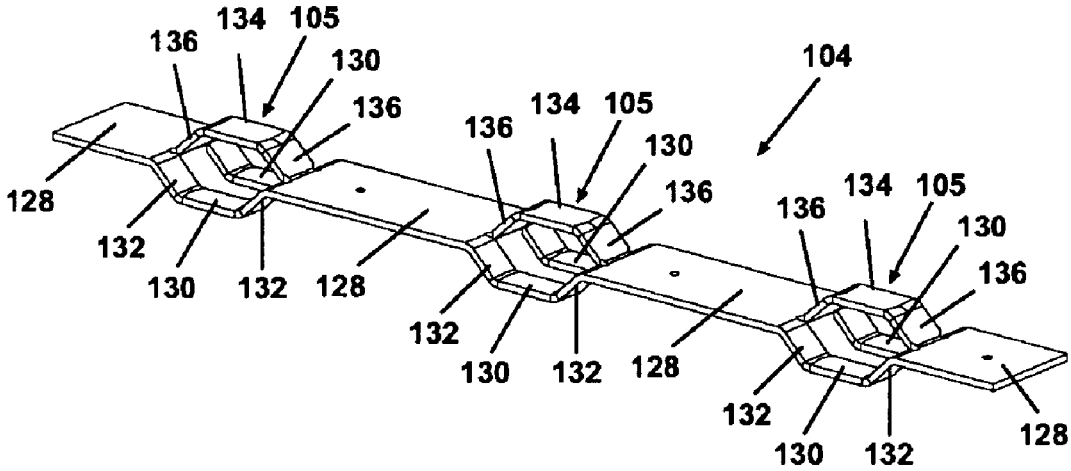
FIG. 10 is an enlarged perspective view of a ground lead illustrated in FIG. 4.

Referring to FIG. 10, a ground lead 104 is similar to the power lead 100, 102, and comprises an elongate, strap-like member fabricated of an electrically-conductive material such as copper, copper alloy, brass, or aluminum. The ground lead 104 comprises a plurality of longitudinal sections 128 alternating with a plurality of ground pin receptacles 105. The ground pin receptacles or 105 comprise short strap-like members separated by longitudinal slits and formed into a pair of offset sections 130 and an inset section 134 adapted for slidable engagement with the ground pin of an electrical power plug. The offset sections 130 and in said sections 134 transition smoothly from the longitudinal sections 128 by inclined sections 132, 136, respectively. The length of the ground lead 104 and position of the ground pin receptacle 105 are adapted for slidable insertion into the medial housing 98 as shown in FIG. 8.

The medial housing 98 comprises an elongate, bilaterally symmetrical structure comprising a plurality of ground pin receptacles 150 separated by a plurality of ground lead channels 144. The ground pin receptacles 150 comprise a pair of parallel, spaced-apart medial offset walls 156 transitioning smoothly through inclined walls 158 to a pair of parallel, spaced-apart longitudinal walls 152. The longitudinal walls 152 define a relatively narrow ground lead channel 144. The ground pin receptacles 150 terminate in a ground lead slot 142.

Extending longitudinally along the medial housing 98 on either side thereof are a plurality of power blade receptacles 146, 148 configured with respect to the ground pin receptacles 150 to accommodate the power blades and ground pin, respectively, of an electrical power plug (not shown). The power blade receptacles 146, 148 comprise medial offset walls 154 parallel to and spaced away from the ground lead channels 144 to form the power blade receptacles 146, 148.

The power blade receptacles 146, 148 are cooperatively aligned with the power blade slots 80, 82. Similarly, the ground pin receptacles 150 are cooperatively aligned with the ground pin opening 78. As well, the mounting side housing 20 and the plug side housing 22 are adapted so that when the housings 20, 22 are assembled into the flexible jumper receptacle 10, the power blade receptacles 146, 148 are cooperatively aligned with the power blade receptacles 62, 64 and the ground pin receptacle 150 is cooperatively aligned with the ground pin receptacles 60.

Figure 11A:
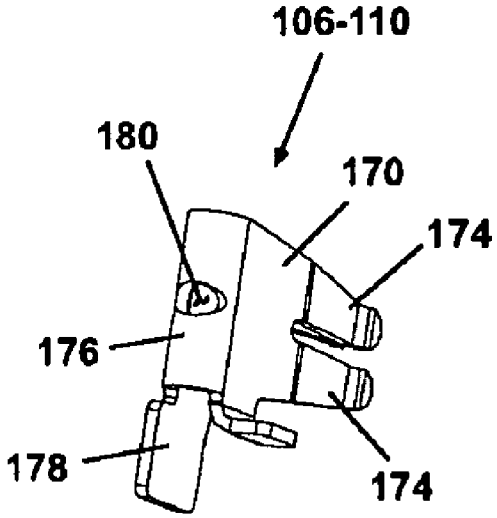
FIG. 11A is a first perspective view of a clip terminal comprising part of the power terminal assembly illustrated in FIG. 4.
Figure 11B:
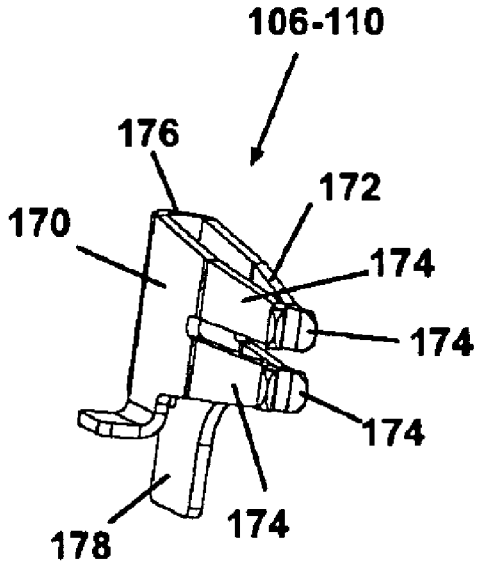
FIG. 11B is a second perspective view of a clip terminal comprising part of the power terminal assembly illustrated in FIG. 4.

FIGS. 8 and 11A–B illustrate a power clip terminal 106 and a ground clip terminal 108, 110, which are identical. Each terminal 106–110 comprises a somewhat irregular U-shaped body comprising a pair of opposed arms 170, 172 joined by a bight section 176 having a mounting aperture 180 centered therethrough. The opposed arms 170, 172 each further comprise a pair of fingers 174. The bight section 176 is configured so that each pair of opposed fingers 174 is urged into resilient contact. Extending longitudinally from one of the arms 172 is a jumper tag 178 adapted for electrical connection of a wire or similar lead (not shown). The terminals 106–110 are fabricated of an electrically conductive material such as copper or copper alloy. The resiliency of the fingers 174 enables a plate-like electrical connector (not shown) to be slidably inserted between the fingers 174, thereby providing electrical conductivity between the terminal 106–110 and the connector.

Figure 12A:
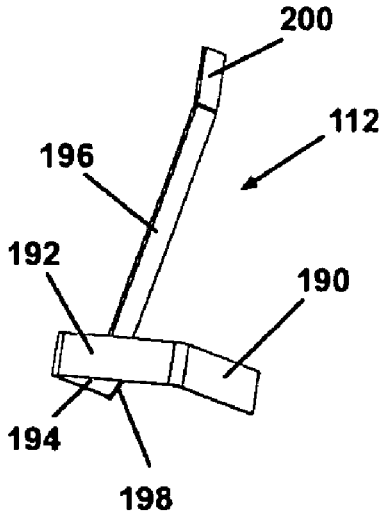
FIGS. 12A–C are perspective views of a first flexible jumper illustrated in FIG. 4.
Figure 12B:
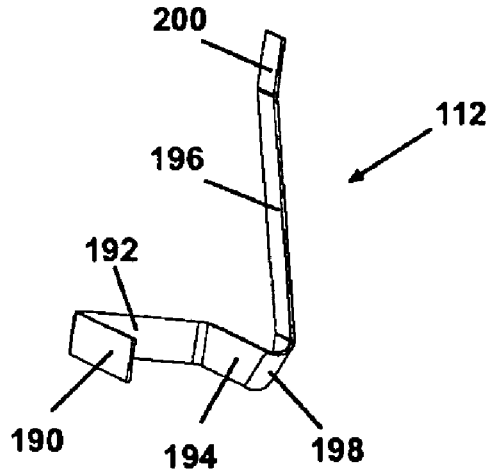
Figure 12C:
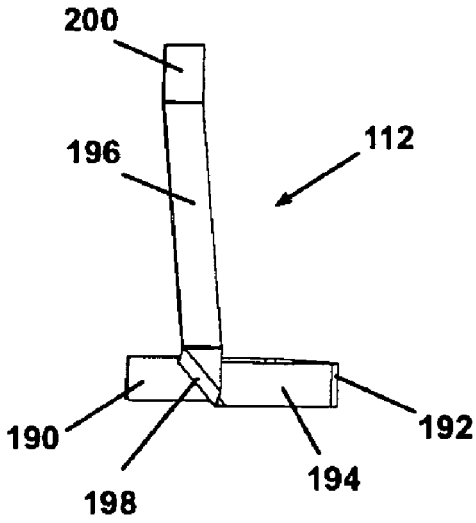

FIGS. 12A–C illustrate a flexible jumper 112 for providing electrical connectivity between the power lead 100 and a power clip terminal 106. The flexible jumper 112 is an elongate, strap-like member fabricated of an electrically-conductive material such as copper, copper alloy, brass, or aluminum. The jumper 112 is formed into a generally L-shaped body comprising a relatively short connecting leg 190 transitioning orthogonally into a relatively short transverse leg 192 transitioning orthogonally into a relatively short support leg 194. Extending laterally from the support leg 194 is a relatively long clip terminal leg 196 terminating in a terminal tag 200. The clip terminal leg 196 is connected to the support leg 194 through an orthogonal bend 198. The jumper 112 can also comprise a wire, or a strap-like member assuming alternative configurations, provided the connecting leg 190 and the terminal tag 200 can be placed generally in the same relative position as that illustrated in FIGS. 12A–C.

Figure 13A:
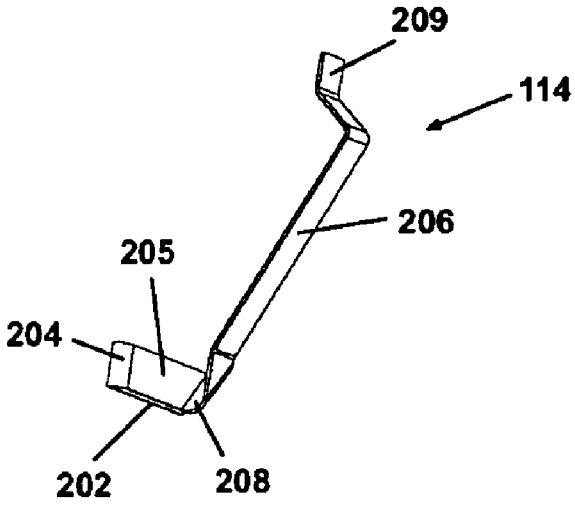
FIGS. 13A–C are perspective views of a second flexible jumper illustrated in FIG. 4.
Figure 13B:
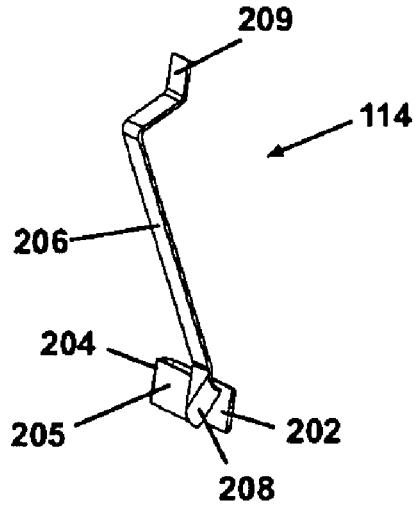
Figure 13C:
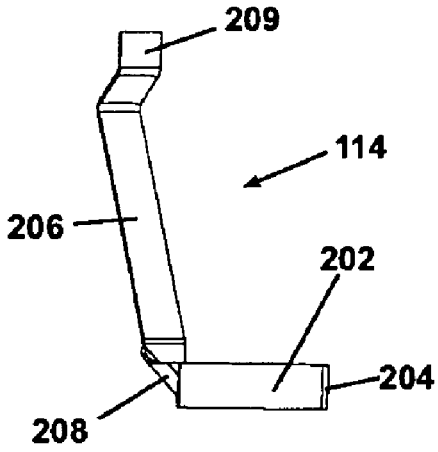

FIGS. 13A–C illustrate a flexible jumper 114 for providing electrical connectivity between the power lead 102 and a power clip terminal 106. The flexible jumper 114 is illustrated as an elongate, strap-like member fabricated of an electrically-conductive material such as copper or aluminum. The jumper 114 is formed into a generally L-shaped body comprising a relatively short connecting leg 202 transitioning through a bight portion 204 into a relatively short support leg 205 spaced somewhat away from and parallel to the connecting leg. The support leg 205 transitions orthogonally into a relatively long clip terminal leg 206 terminating in a terminal tag 209. The clip terminal leg 206 is connected to the support leg 205 through an orthogonal bend 208. The jumper 114 can also comprise a wire, or a strap-like member assuming alternative configurations, provided the connecting leg 202 and the terminal tag 209 can be placed generally in the same relative position as that illustrated in FIGS. 13A–C.

Figure 14A:
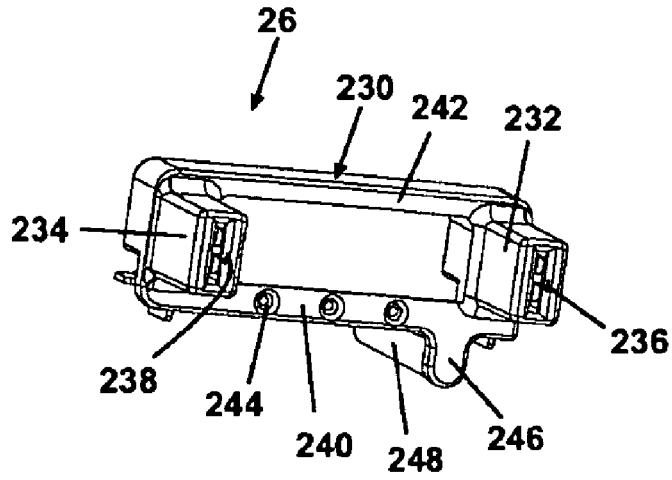
FIGS. 14A–C are perspective views of the circuit selector illustrated in FIG. 4.
Figure 14B:
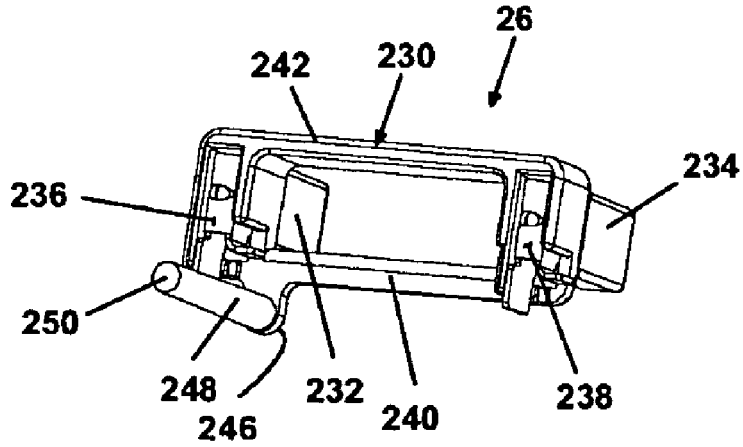
Figure 14C:
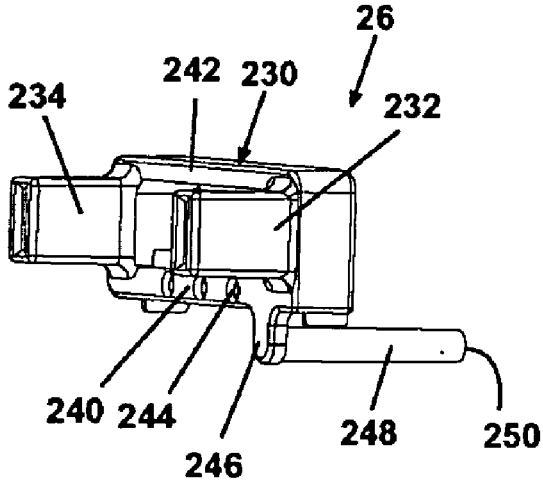

FIGS. 14A–C illustrate a circuit selector 26. The circuit selector 26 is a generally elongate, somewhat rectilinear body comprising a slider 230 extending between a pair of parallel, spaced-apart power clip terminal pedestals 232, 234. The power clip terminal pedestals 232, 234 comprise hollow, generally rectilinear, box-like bodies defining power clip terminal chambers 236, 238, respectively. The power clip terminal pedestals 232, 234 are rigidly connected by a connecting beam 240 and a connecting plate 242 extending therebetween in parallel juxtaposition. The connecting beam 240 is provided with a plurality of detents 244 corresponding to the number of electrical circuits with which the flexible jumper receptacle 10 may be used, illustrated in FIGS. 14A–C as numbering three. The detents 244 are illustrated on the same side of the beam 240 as the power clip terminal pedestals 232, 234. A flange 246 extends away from the beam 240 coplanar therewith, from which extends an elongate, cylindrical post 248 terminating in a tip 250. The post 248 extends orthogonally from the flange 246 away from the power clip terminal pedestals 232, 234. The tip 250 can be provided with a bright color to facilitate the identification of the tip 250 through the circuit identity apertures 84 and the circuit selected.

Referring again to FIG. 8, the flexible jumper receptacle 10 is assembled by first inserting the power leads 100, 102 into the plug power bank 90 so that the plug blade receptacles 101 are received within the power blade receptacles 146, 148. The connecting leg 190 of the flexible jumper 112 is electrically connected, such as by welding, soldering, brazing, and the like, to a longitudinal section 116 of the power lead 100 so that the terminal tag 200 extends toward the slider bridge 92. Similarly, the connecting leg 202 of the flexible jumper 114 is electrically connected, such as by welding, soldering, brazing, and the like, to a longitudinal section 116 of the power lead 102 so that the terminal tag 209 extends toward the slider bridge 92. The ground lead 104 is inserted into the medial housing 98 so that the ground pin receptacles 105 are received in the ground pin receptacles 150 and the longitudinal sections 128 extend through the ground lead slots 142 and ground lead channels 144. An electrical connector, such as a short strand of electrical wire, is connected, such as bywelding or soldering, from a longitudinal section 128 to the jumper tag 178 of a ground clip terminal 110. The ground clip terminal 110 is then rigidly attached to the slider bridge 92 with the bight section 176 attached to the bridge 92 and the fingers 174 extending away from bridge 92. The ground clip terminal 110 can be attached to the slider bridge 92 with a pin (not shown) extending from the slider bridge 92 through the mounting aperture 180.

The terminal tags 200, 209 of the flexible jumpers 112, 114 are electrically connected to the jumper tags 178 of the power clip terminals 106, 108, such as by welding or soldering, so that the bight section 176 of the power clip terminals 106, 108 is in contact with the slider bridge 92 and the fingers 174 extend away from the bridge 92. The circuit selector 26 is installed by inserting the power clip terminals 106, 108 into the power clip terminal chambers 236, 238 so that the slider 230 is in slidable contact with the slider bridge 92, and the ground clip terminal 110 extends between the power clip terminal pedestals 232, 234, the connecting beam 240, and the connecting plate 242. Additionally, the circuit selector 26 is installed so that the tip 250 of the post 248 is positioned for alignment with the circuit identity apertures 84 as the circuit selector 26 is slidably translated along the slider bridge 92, and the slider boss 56 is positioned for alignment with the detents 244 as the circuit selector 26 is slidably translated along the slider bridge 92. Each of the detents 244 and the circuit identity apertures 84 correspond to a preselected electrical circuit.

As will be readily understood by one having an ordinary level of skill in the art, the above-described assembly will provide electrical conductivity between the power clip terminal 108 and the power lead 102, the power clip terminal 106 and the power lead 100, and the ground clip terminal 110 and the ground lead 104. Furthermore, as the circuit selector 26 is slidably translated along the slider bridge 92, the flexible jumpers 112, 114 will flex so that electrical connectivity is maintained regardless of the position of the circuit selector 26 or the flexure of the flexible jumpers 112, 114.

To complete the assembly, the mounting-side housing 20 is attached to the plug-side housing 22 by aligning the pins 38 with the pin receptacles 88 and extending the power clip terminal pedestals 232, 234 through the slider slots 40, 42, respectively. The mounting-side housing 20 is secured to the plug-side housing 22 by cold staking the pins 38 into a rivet-like configuration. The circuit selector 26 can be slidably translated by grasping and moving the power clip terminal pedestals 232, 234 within the slider slots 40, 42 to select a desired electrical circuit for the flexible jumper receptacle 10. The circuit selected will be indicated by the appearance of the tip 250 through one of the circuit identity apertures 84.

Figure 15:
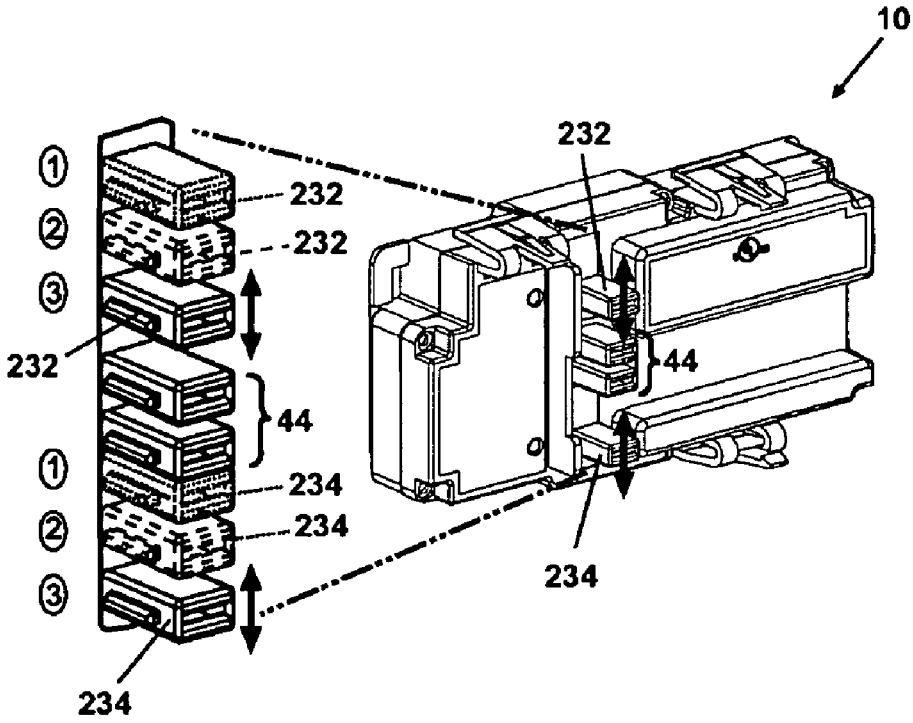
FIG. 15 is a perspective view of the mounting side of the flexible jumper receptacle illustrated in FIG. 3 with the circuit selector in one of three positions.
Figure 16:
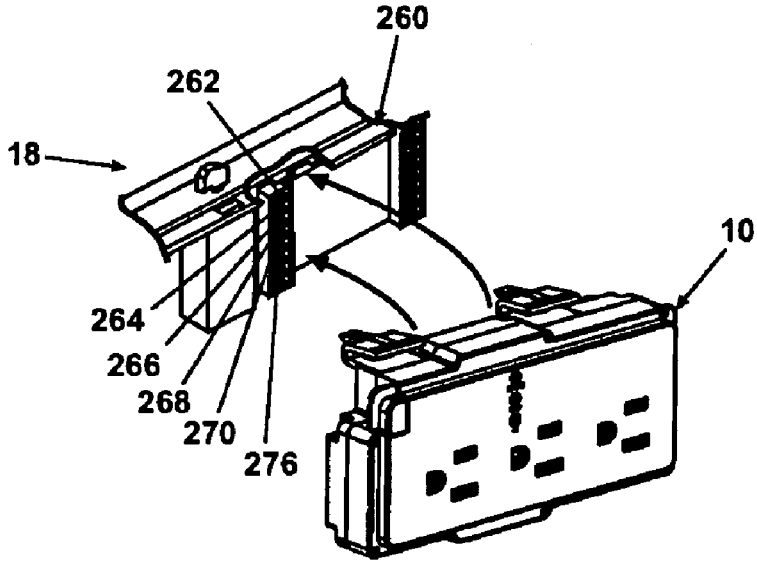
FIG. 16 is a perspective view of the flexible jumper receptacle being mounted to the integrated power supply illustrated in FIG. 2.

Referring now to FIGS. 15 and 16, installation and setting of the flexible jumper receptacle 10 will be described. As illustrated in FIG. 16, the power distribution assembly 18 comprises a power block 260. The power block 260 is served by a power supply (not shown) generally comprising a wiring harness serving one or more electrical power supply circuits. The wiring harness is electrically connected to an array of power terminals 262–276 adapted for connection with the flexible jumper receptacle 10. As illustrated in FIG. 16, the array comprises a first circuit hot terminal 262, a second circuit hot terminal 264, a third circuit hot terminal 266, a common ground terminal 268, an isolated ground terminal 270, a first circuit neutral terminal 272 a second circuit neutral terminal 274, and a third circuit neutral terminal 276. The isolated ground terminal 270 is selected when it is desired to ground the flexible jumper receptacle 10 to an isolated ground not common with the ground serving other receptacles, such as when the receptacle 10 is to supply sensitive electronic equipment that may be affected by stray voltages or varying ground conditions resulting from the other receptacles and equipment.

Referring now to FIG. 15, the circuit selector 26 is moved to select the desired circuit to serve the assembled flexible jumper receptacle 10. For example, if circuit number 1 is to be used, corresponding to the first circuit hot terminal 262 and the first circuit neutral terminal 272, the circuit selector 26 is moved so that the power clip terminal pedestal 232 slidably engages the first circuit hot terminal 262 and the power clip terminal pedestal 234 slidably engages the first circuit neutral terminal 272. The ground terminal pedestal 44 will slidably engage the common ground terminal 268 and the isolated ground terminal 270, regardless of the circuit selected. If circuit number 2 or 3 is to be used, the circuit selector 26 is moved to select the appropriate circuit, with the power clip terminal pedestals 232, 234 engaging the appropriate hot terminals 264, 266 and neutral terminals 274, 276, as illustrated in FIG. 15. The flexible jumper receptacle 10 can be removably secured to the power block 260 by well-known fasteners, such as screws, clips, and the like.

The flexible jumper receptacle 10 comprises fewer and simpler components than prior art receptacles. The cost of fabrication and assembly are thus reduced. The operation of the receptacle 10 is improved through the elimination of moving components, particularly components that must slide relative to each other while maintaining acceptable electrical continuity. In addition to improved operation, the reduction in moving parts results in a useful life for the flexible jumper receptacle 10 that is substantially increased.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

We claim:

1. A modular power plug receptacle having a front wall adapted to receive at least one power plug for use with an electric power supply comprising an array of paired power supply terminals corresponding to at least two electric power supply circuits and at least one ground terminal, the modular power plug receptacle comprising:

a movable circuit selector;

a power terminal assembly comprising at least two pair of positive electrical terminals and neutral electrical terminals aligned orthogonal to the front wall; and at least one flexible jumper electrically interconnecting the power terminal assembly and the circuit selector, wherein the at least one flexible jumper comprises a strap-like member having a first end adapted to be connected to the movable circuit selector and a second end having a U-shaped portion thereon, the U-shaped portion having at least one leg positioned adjacent to and mounted to at least one of the positive and neutral electrical terminals;

whereby the at least one flexible jumper comprises an uninterrupted connection joining the circuit selector and the power terminal assembly and whereby the at least one flexible jumper enables the circuit selector to be moved relative to the power terminal assembly.

2. A modular power plug receptacle according to claim 1, wherein the at least one flexible jumper comprises one of copper, copper alloy, brass, or aluminum.

3. A modular power plug receptacle according to claim 1, wherein the circuit selector is movable to select one of at least two electric power supply circuits.

4. A modular power plug receptacle according to claim 1, and further comprising a circuit indicator for identifying the selected one of the at least two electric power supply circuits.

5. The modular power plug receptacle according to claim 4 wherein the front wall further comprises a plurality of circuit selector openings corresponding to each of the at least two electric power supply circuits.

6. The modular power plug receptacle according to claim 5 wherein the movable circuit selector further comprises an indicator extending therefrom and in register with one of the plurality of circuit selector openings, whereby, as the movable circuit selector is repositioned to select different ones of the at least two electric power supply circuits, the indicator is aligned with a different one of the plurality of circuit selector openings.

7. In a modular power plug receptacle for use with an electric power supply comprising an array of paired power supply terminals corresponding to at least two electric power supply circuits and at least one ground terminal, the modular power plug receptacle comprising a movable circuit selector and a power terminal assembly, the improvement comprising:

at least one flexible jumper electrically interconnecting the power terminal assembly and the circuit selector, wherein the at least one flexible jumper comprises a strap-like member having a first end adapted to be connected to the circuit selector and a second end having a U-shaped portion thereon, the U-shaped portion having at least one leg positioned adjacent to and mounted to the power terminal assembly;

whereby the at least one flexible jumper provides electrical connectivity between the circuit selector and the power terminal assembly to enable the circuit selector to be moved without interruption of the electrical connectivity.

8. A modular power plug receptacle according to claim 7, wherein the at least one flexible jumper comprises one of copper, copper alloy, brass, or aluminum.

9. A modular power plug receptacle according to claim 7, wherein the circuit selector is movable to select one of at least two electric power supply circuits.

10. A modular power plug receptacle according to claim 7, and further comprising a circuit indicator for identifying the selected one of the at least two electric power supply circuits.

11. The modular power plug receptacle according to claim 10 and further comprising a front panel defining insertion apertures for the array of paired power supply terminals and a plurality of circuit selector openings corresponding to each of the at least two electric power supply circuits.

12. The modular power plug receptacle according to claim 11 wherein the movable circuit selector further comprises an indicator extending therefrom and in register with one of the plurality of circuit selector openings, whereby, as the movable circuit selector is repositioned to select different ones of the at least two electric power supply circuits, the indicator is aligned with a different one of the plurality of circuit selector openings.

13. A modular power plug receptacle having a front wall adapted to receive at least one power plug for use with an electric power supply comprising an array of paired power supply terminals corresponding to at least two electric power supply circuits and at least one ground terminal, the modular power plug receptacle comprising:

a power terminal assembly comprising at least two pair of positive electrical terminals and neutral electrical terminals aligned orthogonal to the front wall;

a plurality of circuit selector openings in the front wall corresponding to each of the at least two electric power supply circuits; and a movable circuit selector having an indicator extending therefrom and in register with one of the plurality of circuit selector openings;

whereby, as the movable circuit selector is repositioned to select different ones of the at least two electric power supply circuits, the indicator is aligned with a different one of the plurality of circuit selector openings.

14. The modular power plug receptacle according to claim 13 and further comprising at least one flexible jumper electrically interconnecting the power terminal assembly and the circuit selector.

15. The modular power plug receptacle according to claim 14 wherein the at least one flexible jumper comprises a strap-like member having a first end adapted to be connected to the movable circuit selector and a second end having a U-shaped portion thereon, the U-shaped portion having at least one leg positioned adjacent to and mounted to at least one of the positive electrical terminals, whereby the at least one flexible jumper comprises an uninterrupted connection joining the circuit selector and the power terminal assembly and whereby the at least one flexible jumper enables the circuit selector to be moved relative to the power terminal assembly.

* * * * *